US006397504B1

(12) United States Patent
McFetridge

(10) Patent No.: US 6,397,504 B1
(45) Date of Patent: Jun. 4, 2002

(54) METHOD FOR DISPLAYING INFORMATION IN A VEHICLE WINDOW AND A VEHICLE WINDOW DISPLAY APPARATUS

(76) Inventor: Kelly Archibald McFetridge, 11820 - 10 Avenue, Edmonton, Alberta (CA), T6J 7A6

( * ) Notice: Subject to any disclaimer, the term of this patent is extended or adjusted under 35 U.S.C. 154(b) by 0 days.

(21) Appl. No.: 09/487,511

(22) Filed: Jan. 19, 2000

(30) Foreign Application Priority Data

Jan. 19, 1999 (CA) ..... 2260110

(51) Int. Cl.[7] ..... G09F 21/04

(52) U.S. Cl. ..... 40/591; 40/643; 40/911; 224/482; 160/DIG. 2

(58) Field of Search ..... 40/591, 593, 124.06, 40/643, 611, 644, 661, 911; 160/105, DIG. 2; 224/482

(56) References Cited

U.S. PATENT DOCUMENTS 2,027,676 A * 1/1936 Chuchie ..... 40/591
2,550,796 A * 5/1951 Francis ..... 40/593
3,237,327 A * 3/1966 Groggs ..... 40/591
3,293,779 A * 12/1966 Vogeli, Sr. ..... 40/591
3,531,880 A * 10/1970 Ramee ..... 40/591
3,553,865 A * 1/1971 Jones ..... 40/591
4,560,251 A * 12/1985 Murjahn ..... 296/97 R
D303,403 S * 9/1989 Barcom ..... 40/643
4,921,296 A * 5/1990 Gruber ..... 296/97.2
5,022,701 A * 6/1991 Thompson, II ..... 160/105
5,033,786 A * 7/1991 Bickford ..... 40/593
5,069,376 A * 12/1991 Barel ..... 40/643

* cited by examiner

*Primary Examiner*—Lynne H. Browne
*Assistant Examiner*—Kenn Thompson
(74) *Attorney, Agent, or Firm*—Christensen O'Connor Johnson Kindness PLLC

(57) ABSTRACT

A method for displaying information in a vehicle window. A first step involves providing a window display apparatus which includes a substantially planar body having a first face and a second face. The body has an integrally formed pocket with a transparent viewing window on one of the first face and the second face. A second step involves inserting a sheet having printed information into the pocket with the printed information visible through the transparent viewing window. A third step involves inserting the body into a window well of a vehicle with the transparent viewing window of the pocket against a window of the vehicle such that the printed information is visible through the window of the vehicle.

14 Claims, 6 Drawing Sheets

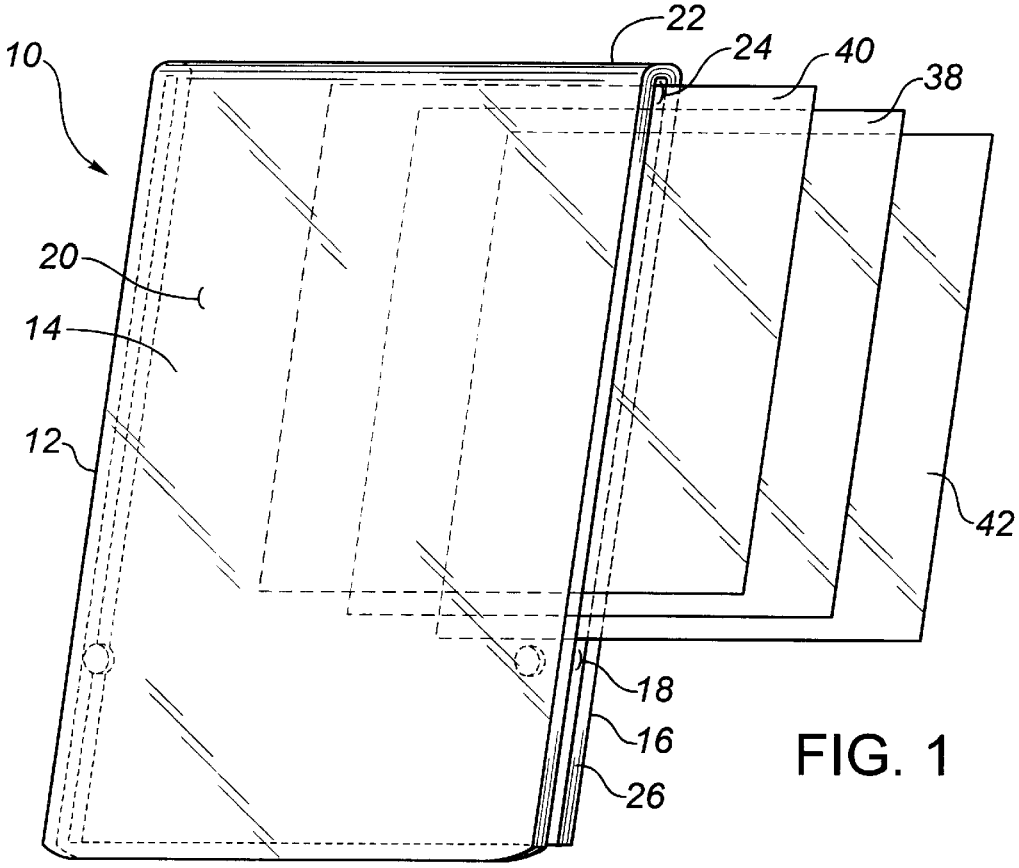
FIG. 1
FIG. 2
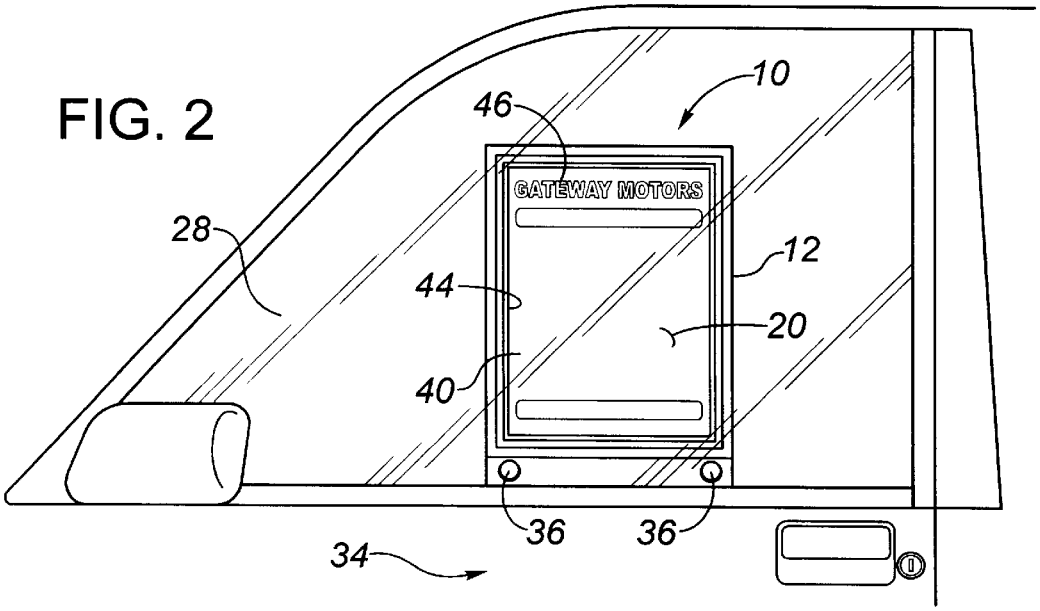

METHOD FOR DISPLAYING INFORMATION IN A VEHICLE WINDOW AND A VEHICLE WINDOW DISPLAY APPARATUS

FIELD OF THE INVENTION

The present invention relates to a method for displaying information in a vehicle window and a vehicle window display apparatus in accordance with the teachings of the method.

BACKGROUND OF THE INVENTION

Every vehicle sales lot places a window sticker on a window of a vehicle that is for sale. The window sticker provides a means of displaying to potential customers the standard factory features, factory installed options, dealer installed options, and list price for the vehicle.

Window stickers are attached by adhesive to the window of the vehicle. Care must be taken in positioning the window sticker in the first instance. If the window sticker is inadvertently positioned at an angle, it does not show well. In the process of removing the window sticker, it is invariably destroyed.

It has long been recognized that there are inherent drawbacks associated with the fact that window stickers cannot be readily attached and detached. The window stickers obscure vision during test drives and, as such, are a contributing factor to motor vehicle accidents. They are a nuisance to replace should the information on the window sticker be in need of updating due to the addition of a dealer installed option or a change in the list price. A window sticker can become dogeared and worn as a result of frequent raising and lowering of the window to which it is adhered.

SUMMARY OF THE INVENTION

What is required is an alternative method for displaying information in a vehicle window and a vehicle window display apparatus that will provide an alternative to a window sticker.

According to one aspect of the present invention there is provided a method for displaying information in a vehicle window. A first step involves providing a window display apparatus which includes a substantially planar body having a first face and a second face. The body has an integrally formed pocket with a transparent viewing window on one of the first face and the second face. A second step involves inserting a sheet having printed information into the pocket with the printed information visible through the transparent viewing window. A third step involves inserting the body into a window well of a vehicle with the transparent viewing window of the pocket against a window of the vehicle such that the printed information is visible through the window of the vehicle.

In accordance with the teachings of the above described method, the vehicle window display apparatus can readily be inserted. More importantly, the window display apparatus can be readily removed, for example when a vehicle is being test driven. The printed information can be updated at any time by merely substituting a more current information sheet. This provides more flexibility at the vehicle sales lot. Every time the vehicles on the lot are moved, the window display apparatus can be moved so that all window display apparatus face in the same direction.

According to another aspect of the invention there is provided a first embodiment vehicle window display apparatus which includes a substantially planar body having a first face and a second face. The body has an integrally formed pocket with a transparent viewing window on one of the first face and the second face.

Although beneficial results may be obtained through the use of the first embodiment of vehicle window display apparatus, as described above, it is desirable to keep costs of manufacture to a minimum. Even more beneficial results may, therefore, be obtained when the body is comprised of a single sheet of polymer plastic material folded along a top peripheral edge in overlapping relation to form the pocket with an access opening along at least one of the side edges.

Although beneficial results may be obtained through the use of the first embodiment of vehicle window display apparatus, as described above, insertion of the base into the window well adjacent to the window can be difficult in some models due to limited space. Even more beneficial results may, therefore, be obtained when the body has a blade-like depending tail portion, thereby facilitating the insertion of the body into a window well of a vehicle. Where the viewing window is on the first face of the body it is preferred that the blade-like depending tail portion be angled outwardly past the second face.

Although beneficial results may be obtained through the use of the first embodiment of vehicle window display apparatus, as described above, there are curvatures in vehicle windows which vary with different makes and models of vehicle. Even more beneficial results may, therefore, be obtained when the body is resiliently deformable such that the body conforms to a curvature of a window. This can be accomplished by the selection of materials out of which the polymer plastic pocket member is formed. An alternative way of achieving the same result is to position a resiliently deformable backing board in the pocket.

Although beneficial results may be obtained through the use of the first embodiment of vehicle window display apparatus, as described above, where the window well has able space there is a danger that the vehicle window display apparatus will drop down farther into the window well than is desirable. Even more beneficial results may, therefore, be obtained when the body has stop means projecting from the second face, thereby limiting the depth to which the body is insertable into a window well of a vehicle. A preferred form of stop means includes two or more projecting nubs.

Although beneficial results may be obtained through the use of the first embodiment of window display apparatus, as described above, it is important the display apparatus be attractive and draw the eye. It is also beneficial if the window display apparatus displays the corporate colours of the vehicle sales dealership. Even more beneficial results may, therefore, be obtained when a transparent decorative template is positioned in the pocket.

According to the present invention there is provided a second embodiment of vehicle window display apparatus which includes a substantially planar body having a first side and a second side. The first side has a transparent viewing window. An integrally formed planar pocket is positioned between the first side and the second side such that printing on a sheet placed in the planar pocket is visible through the transparent viewing window. The body has a wedge positioned along a bottom edge with a thin blade edge of the wedge being coterminous with the bottom edge.

The use of a wedge, as described above, enables the vehicle window display apparatus to fit a wider range of vehicles. In the preferred construction, the body is made from a polymer plastic material and has a top edge formed where the first side and the second side are conjoined. The body has a first bottom edge and a second bottom edge, the first bottom edge on the first side and the second bottom edge on the second side, with the wedge positioned along the second bottom edge.

Although beneficial results may be obtained through the use of the second embodiment of vehicle window display apparatus, as described above, the thinner the bottom of the body is the easier it is to insert the body into the window well. Even more beneficial results may, therefore be obtained when the second bottom edge that carries the wedge extends below the first bottom edge and past the first side of the body. It is preferred, but not essential that the wedge be integrally formed into the second side.

Although beneficial results may be obtained through the use of the second embodiment of vehicle window display apparatus, as described above, even more beneficial results may be obtained when the wedge is resiliently deformable. This enables the wedge to adapt to work with a wider range of window well sizes and results in the body of the vehicle window display apparatus being held more securely in position.

Although beneficial results may be obtained through the use of the second embodiment of vehicle window display apparatus, as described above, when the body is wedged into position there is a danger that the presence of any grit or dirt could result in the window being scratched. Even more beneficial results may, therefore, be obtained when a fabric strip is positioned on the first side in opposed relation to the wedge.

BRIEF DESCRIPTION OF THE DRAWINGS

These and other features of the invention will become more apparent from the following description in which reference is made to the appended drawings, wherein:

FIG. 1 is an exploded perspective view of a vehicle window display apparatus constructed in accordance with the teachings of the present invention.

FIG. 2 is a front elevation view of the vehicle window display apparatus illustrated in FIG. 1, displayed on a vehicle.

DETAILED DESCRIPTION OF THE PREFERRED EMBODIMENT

Figure 3:
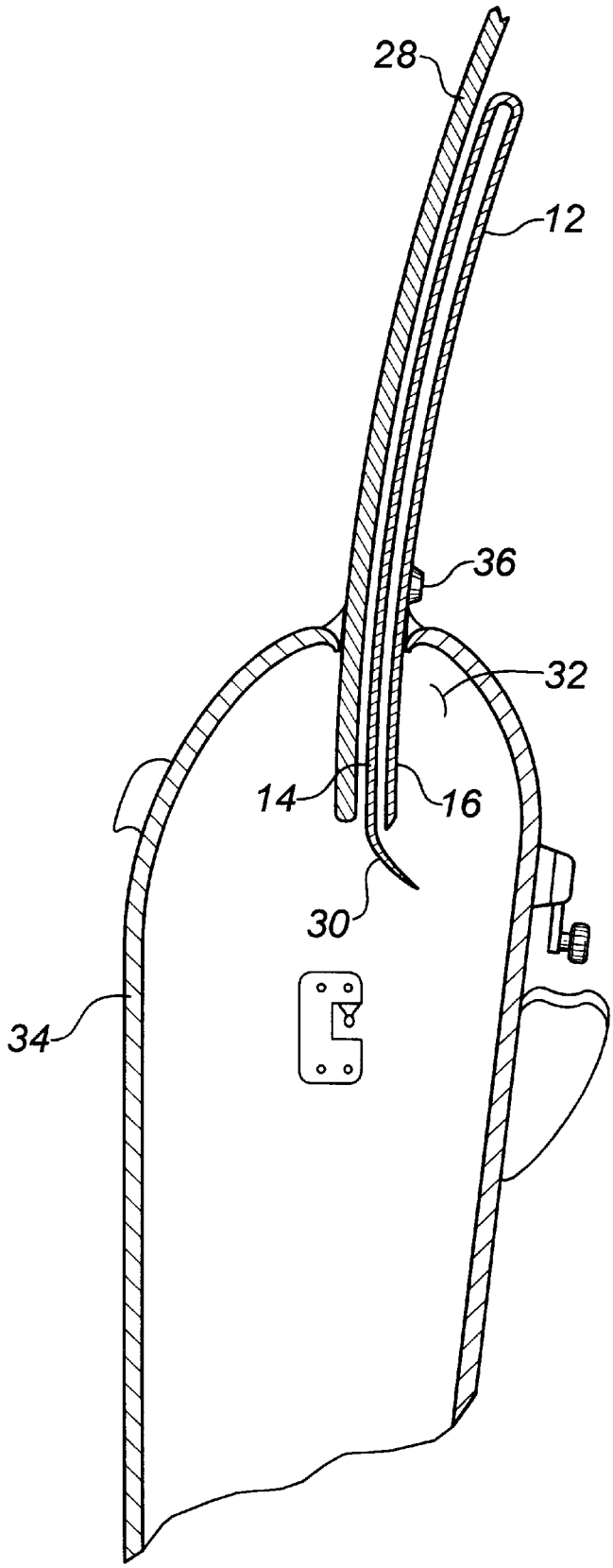
FIG. 3 is an side elevation view, in section, of the vehicle window display apparatus on the vehicle as illustrated in FIG. 2.

A first embodiment of vehicle window display apparatus generally identified by reference numeral 10, will now be described with reference to FIGS. 1 through 3.

Referring to FIG. 1, vehicle window display apparatus 10 includes a substantially planar body 12 having a first face 14 and a second face 16. Body 12 has an integrally formed pocket 18. The entire of body 12 is transparent, which provides a transparent viewing window 20 on first face 14. The preferred mode of construction for body 12 is illustrated with body 12 comprised of a single sheet of polymer plastic material folded along a top peripheral edge 22 in overlapping relation to form pocket 18 with access openings 24 along side edges 26. Referring to FIG. 3, body 12 is resiliently deformable, such that body 12 conforms to a curvature of a vehicle window 28. Body 12 has a blade-like depending tail portion 30 which facilitates the insertion of body 12 into a window well 32 of a vehicle 34. Tail portion 30 is angled inwardly from first face 14 and extends past second face 16. Two nubs 36 project from second face 16 to serve as stop means which limit the depth to which body 12 is insertable into window well 28.

As will hereinafter be further described, there are three sheets inserted into pocket 18. A sheet 38 of printed data giving particulars about the vehicle, options and price information. A transparent decorative template 40 overlies sheet 38 to enhance the appearance of vehicle window display apparatus 10. A backing board 42 underlies printed data. Backing board 42 limits light penetration through transparent body 12. Optionally, backing board 42 can be of resiliently deformable material and used as a means of making body 12 resiliently deformable.

The use and operation of vehicle window display apparatus 10 will now be described with reference to FIGS. 1 through 3. Referring to FIG. 1, personnel at the vehicle sales lot insert sheet 38, overlying transparent decorative template 40 and backing board 42 into pocket 18 of body 12 through access openings 24. Referring to FIG. 2, decorative template 40 preferably has a border 44 in the corporate colours of the vehicle sales lot and bears the corporate logo 46 of the vehicle sales lot. Referring to FIG. 3, body 12 is inserted into window well 32 of a vehicle 34. First face 14 of body 12 is placed up against vehicle window 28. Blade-like tail portion 30 provides a wedge that facilitates entry of body 12 into window well 32. Tail portion 30 is angled inwardly from first face 14 and extends past second face 16. This configuration serves two purposes. Firstly, it closes off the bottom of pocket 18. Secondly, this configuration has proven to be best suited to get past mechanisms within window well 32, as a straight blade catches on the mechanisms in some vehicles. Body 12 is inserted into window well 32 until the two nubs 36 which project from second face 16 stop further insertion. During insertion body 12 conforms with the curvature of vehicle window 28.

Figure 4:
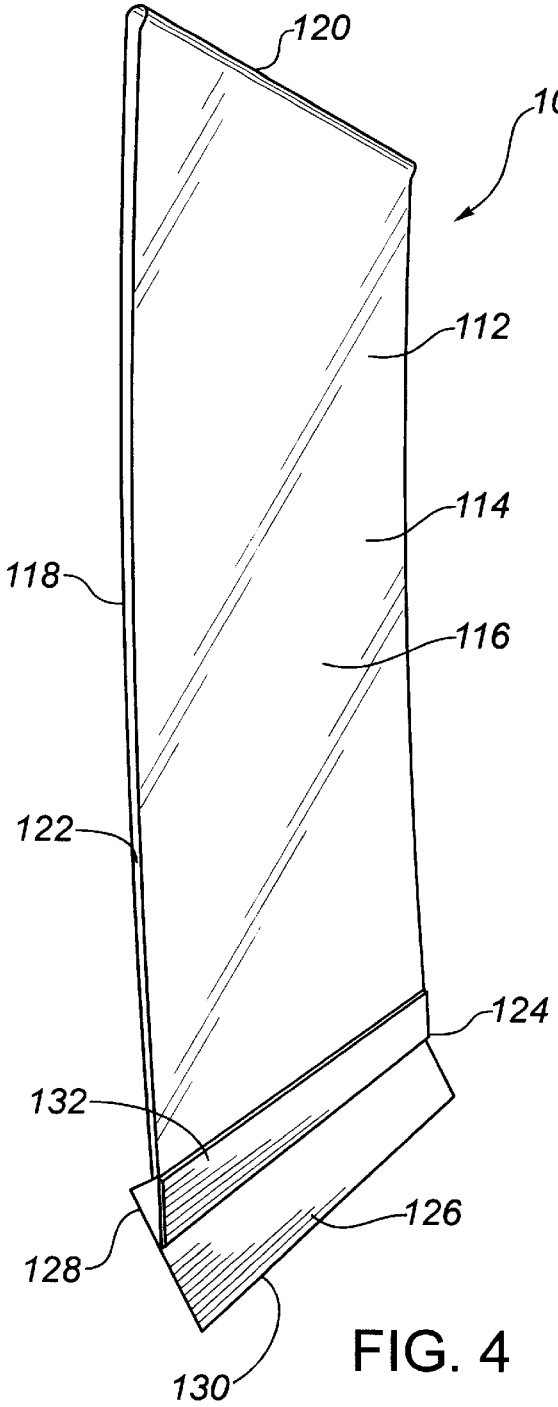
FIG. 4 is a perspective view of a vehicle window display apparatus constructed in accordance with the teachings of the present invention.
Figure 6:
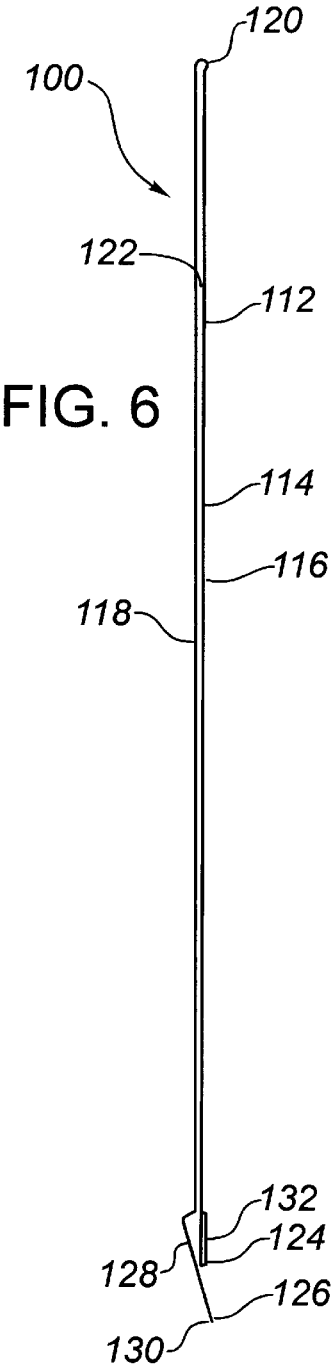
FIG. 6 is an end elevation view of the vehicle window display apparatus illustrated in FIG. 1.
Figure 5:
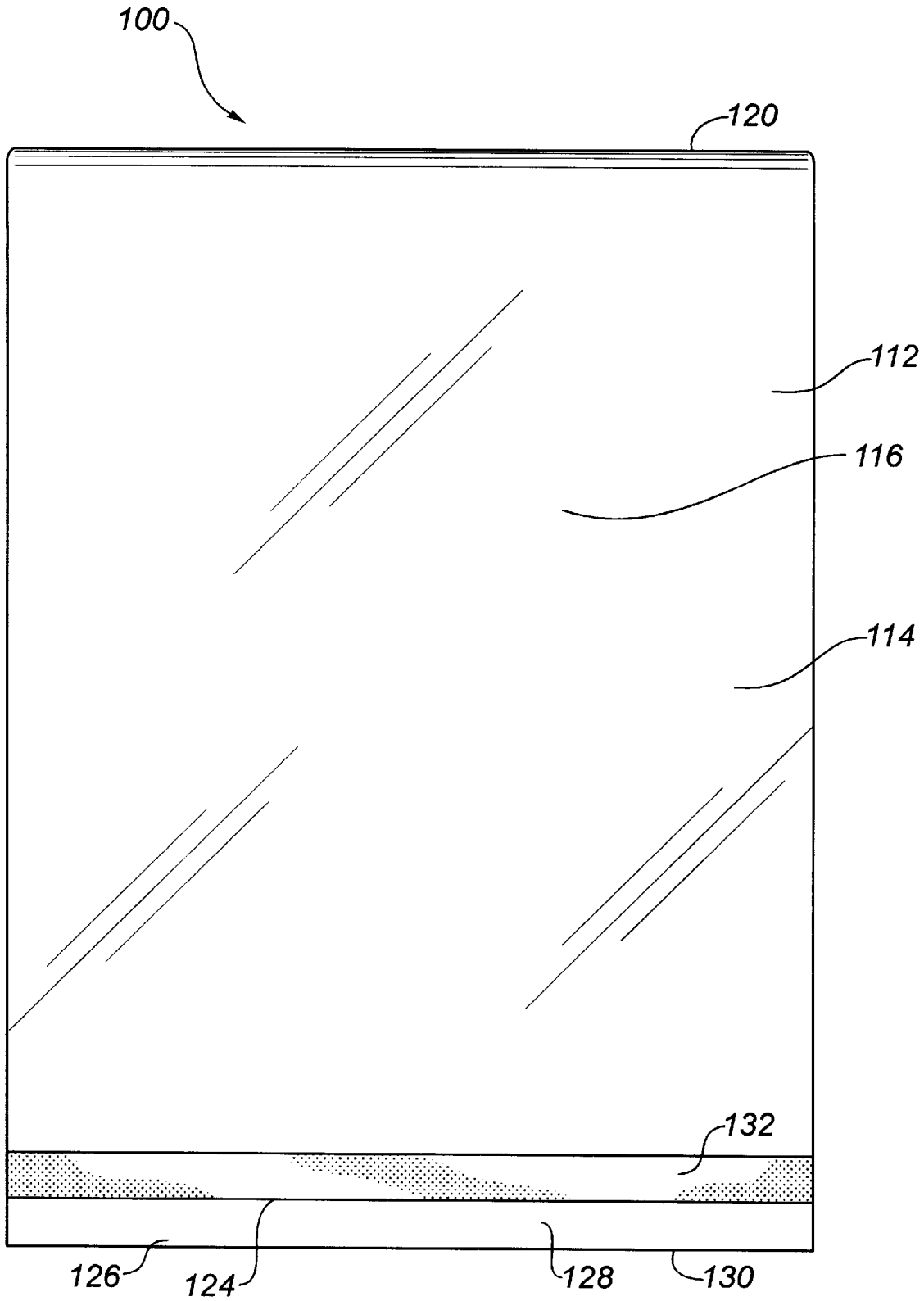
FIG. 5 is a front elevation view of the vehicle window display apparatus illustrated in FIG. 1.

A second embodiment of vehicle window display apparatus generally identified by reference numeral 100, will now be described with reference to FIGS. 4 through 8. Referring to FIG. 4, vehicle window display apparatus 100 includes a substantially planar polymer plastic body 112 having a first side 114 with a transparent viewing window 116 and a second side 118 conjoined at a top edge 120. Referring to FIG. 6, an integrally formed planar pocket 122 is positioned between first side 114 and second side 118. Referring to FIG. 5, when a printed sheet (not shown) is placed in planar pocket 122 any printing on said sheet is visible through transparent viewing window 116. Referring again to FIG. 4, first side 114 has a first bottom edge 124. Second side 118 has a second bottom edge 126. Second bottom edge 126 extends below first bottom edge 124 and past first side 114 of body 112. A resiliently deformable wedge 128 is integrally formed into second side 118. A thin blade edge 130 of wedge 128 is coterminous with second bottom edge 126. It is preferred that wedge 128 have a surface treatment which makes the surface rough rather than smooth, so as to enhance the gripping ability of wedge 128. A fabric strip 132 is positioned on first side 114 in opposed relation to wedge 128.

Figure 7:
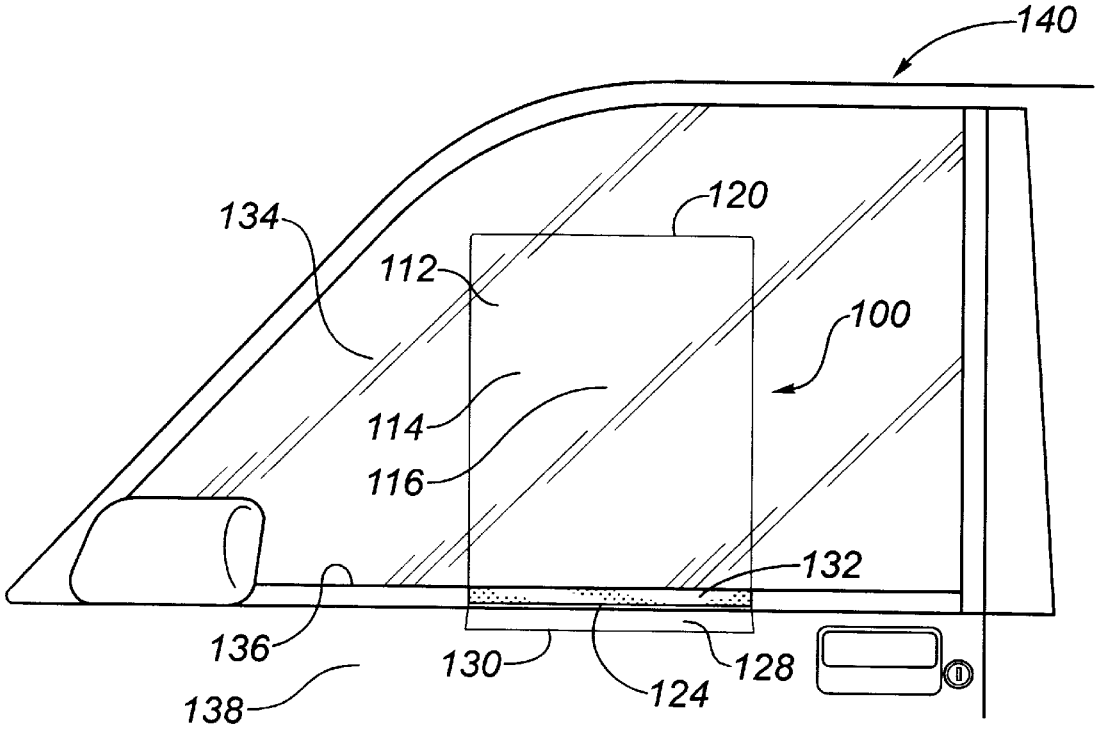
FIG. 7 is a front elevation view of the vehicle window display apparatus illustrated in FIG. 1, positioned in a window of a vehicle.
Figure 8:
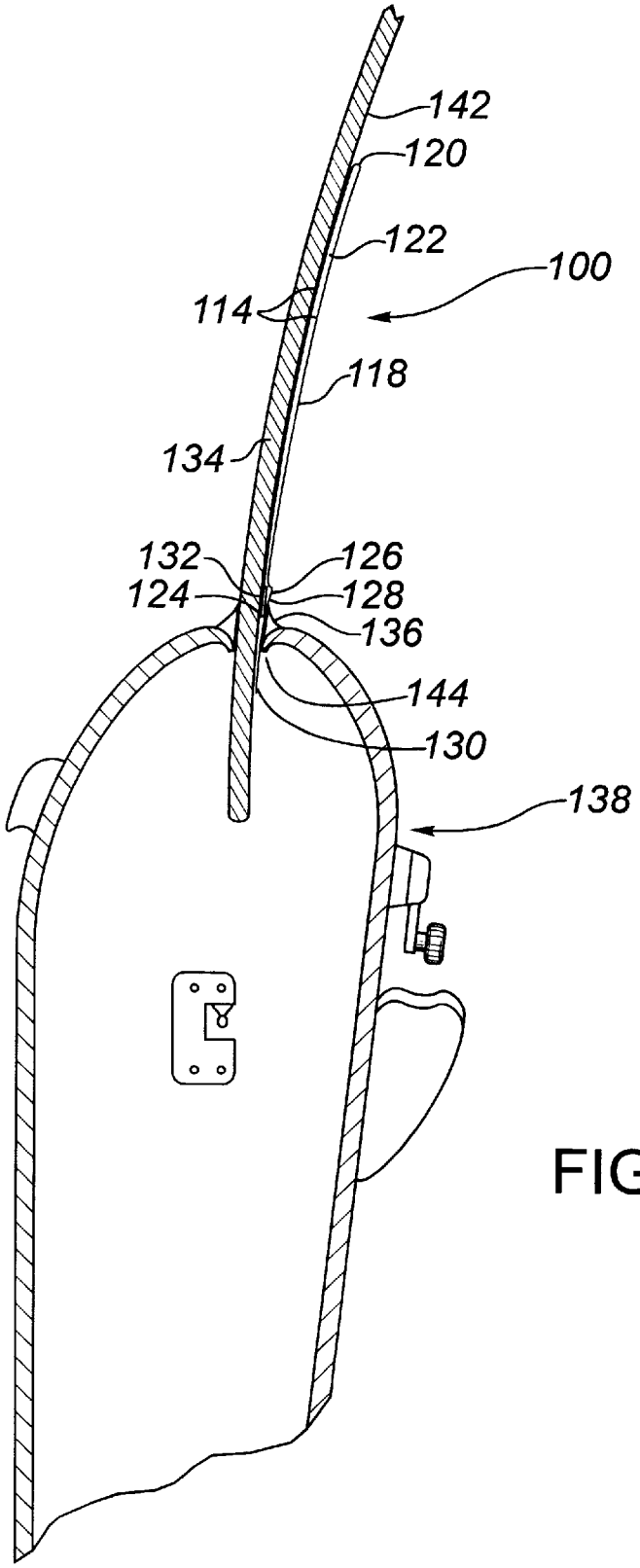
FIG. 8 is an end elevation view of the vehicle window display apparatus illustrated in FIG. 1, positioned in a window of a vehicle.

The use of window display apparatus 100 will now be described with reference to FIGS. 4 through 8. A printed sheet of paper (not shown) is inserted into planar pocket 122 of window display apparatus 100, illustrated in FIGS. 4 through 6. Printed sheet is oriented so that any printing thereon is visible through viewing window 116 of first side 114. Referring to FIG. 8, window display apparatus 100 is inserted between a window 134 and an interior window seal 136 of a door 138 of a motor vehicle 140. Blade edge 130 used to get past window seal 136 and when in position extends below window seal 136, as illustrated in FIGS. 7 and 8. First side 114 faces window 134, thereby allowing a reader to read printed sheet, as illustrated in FIG. 7. Body 112 is resiliently deformable, thereby allowing first side 114 to follow closely the curvature of an interior surface 142 of window 134, as illustrated in FIG. 8. Fabric strip 132 allows insertion of window display apparatus 100 without causing inadvertent scratching of window 134. Bottom edge 130 of wedge 128 is thin thereby allowing facile insertion of wedge 128 between window 134 and seal 136. Wedge 128 is resiliently deformable, as illustrated in FIG. 8, thereby allowing insertion of window display apparatus 100 into a wide range of sizes of window well spacing 144, and more securely holding said window display apparatus 100 therein.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A vehicle window display apparatus, comprising:

a substantially planar body having a first face, a second face and an integrally formed pocket with a transparent viewing window on one of the first face and the second face; and stop means projecting from the second face of the body, thereby limiting the depth to which the body is insertable into a window well of a vehicle.

2. The vehicle window display apparatus as defined in claim 1, wherein the body has a blade-like depending tail portion, thereby facilitating the insertion of the body into a window well of a vehicle.

3. The vehicle window display apparatus as defined in claim 2, wherein the window is on the first face and the blade-like depending tail portion is angled outwardly past the second face.

4. The vehicle window display apparatus as defined in claim 1, wherein the body is comprised of a single sheet of polymer plastic material folded along a top peripheral edge in overlapping relation to form the pocket with an access opening along at least one of the side edges.

5. The vehicle window display apparatus as defined in claim 1, wherein the body is resiliently deformable such that the body conforms to a curvature of a window.

6. The vehicle window display apparatus as defined in claim 1, wherein the stop means includes at least two projecting nubs.

7. The window display apparatus as defined in claim 5, wherein a resiliently deformable backing board is positioned in the pocket member, such that the polymer plastic pocket member conforms to a curvature of a window.

8. The window display apparatus as defined in claim 1, wherein a transparent decorative template is positioned in the pocket member.

9. A vehicle window display apparatus, comprising:

a substantially planar body having a first face, a second face and an integrally formed pocket with a transparent viewing window on the first face;

the body being comprised of a single sheet of polymer plastic material folded along a top peripheral edge in overlapping relation to form the pocket with access openings along the side edges;

the body being resiliently deformable, such that the body conforms to a curvature of a window;

the body having a blade-like depending tail portion, thereby facilitating the insertion of the body into a window well of a vehicle; and stop means projecting from the second face of the body, thereby limiting the depth to which the body is insertable into a window well of a vehicle.

10. The vehicle window display apparatus as defined in claim 9, wherein the stop means includes two projecting nubs.

11. The vehicle window display apparatus as defined in claim 9, wherein the blade-like depending tail portion is angled inwardly from the first face and extends past the second face.

12. The window display apparatus as defined in claim 9, wherein a transparent decorative template is positioned in the pocket member.

13. The window display apparatus as defined in claim 9, wherein a backing board is positioned in the pocket member, thereby limiting light penetration through the body.

14. The window display apparatus as defined in claim 9, having transparent viewing windows on both the first face and the second face.

* * * * *